US005807160A

United States Patent [19]

Wehmeyer

[11] Patent Number: 5,807,160

[45] Date of Patent: Sep. 15, 1998

[54] CLEAVAGE WRINKLE PROTECTOR

[76] Inventor: Jenny Iten Wehmeyer, 17885 Co. Rd. 467, St. James, Mo. 65559

[21] Appl. No.: 749,919

[22] Filed: Feb. 18, 1997

[51] Int. Cl.[6] ..... A41C 3/00; A41C 3/12

[52] U.S. Cl. ..... 450/57; 2/73; 2/267; 2/1

[58] Field of Search ..... 450/30, 31, 32, 450/53, 54, 55, 56, 57; 2/73, 267, 1; 11/455

[56] References Cited

U.S. PATENT DOCUMENTS

| | | | |
|---|---|---|---|
| 147,264 | 2/1874 | Hodgkins | 450/57 |
| 862,376 | 8/1907 | Bachman | 450/57 |
| 1,891,871 | 12/1932 | Donnet | 450/53 |
| 2,505,720 | 4/1950 | Peiser et al. | 450/56 |
| 2,558,175 | 9/1951 | Ullrich | 450/54 |
| 5,045,018 | 9/1991 | Costanzo | 450/56 |

*Primary Examiner*—Jeanette E. Chapman

[57] ABSTRACT

A cleavage wrinkle protector is constructed of satin or similar lingerie type fabric and stuffed with polyester fiber-fill. The protector includes stretch lace neck and torso straps. The protector is approximately 6½ inches long and 2½ inches side. The protector is designed to be worn between the woman's breast while sleeping to protect the cleavage skin from folding when she lies on her side.

1 Claim, 2 Drawing Sheets

NOTE: ALL NUMBERS IN FIGURE 1A COINCIDE WITH FIGURE 3

CLEAVAGE WRINKLE PROTECTOR

BACKGROUND

This invention relates to the prevention of wrinkles in the cleavage area, which develop when women are lying on their shoulders and sides while sleeping causing creasing and folding of the skin in the cleavage area. With age and repetition of this sleeping pattern, the cleavage skin permanently wrinkles so that visible, permanent and unsightly lines progressively diminish the youthfulness and beauty of a woman's upper chest area and cleavage.

The object of this invention is to provide a pad to be worn between the breast while sleeping preventing the skin between the breast from folding.

Another object of the invention is to provide an item made of smooth fabric with soft and stretchable straps.

With the forgoing objectives, the invention consist of simple design and construction combining more fully described in the claims and specification; it being understood that changes may be made in the construction, adornment or use of fastening devices or arrangement of parts without departing from the spirit of the invention as claimed.

DETAILED DESCRIPTION

Figure 1:
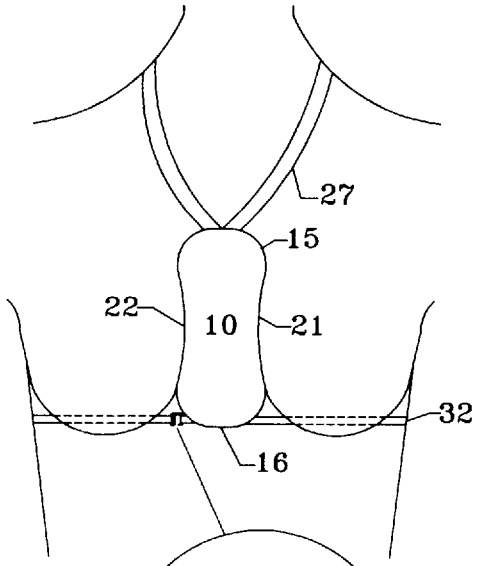
FIG. 1: shows a front view illustrating the support pad constructed in accordance with the invention and as positioned for use, fitting between the breast with the neck and torso straps.
Figure 1A:
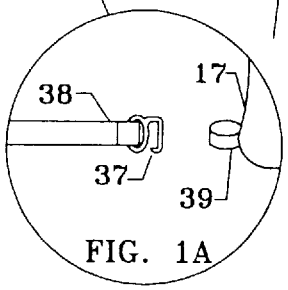
FIG. 1*a*: shows the fastener device for the torso strap.
Figure 2:
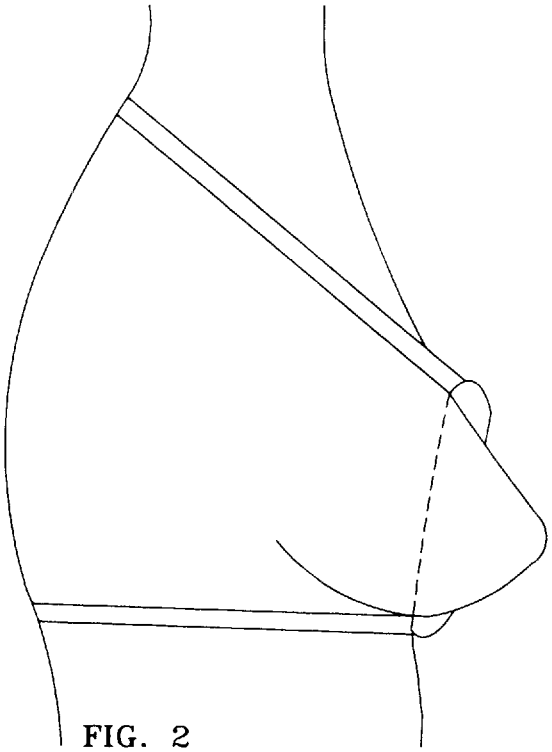
FIG. 2: shows a side view of the neck and torso straps holding the support pad between the breast.
Figure 3:
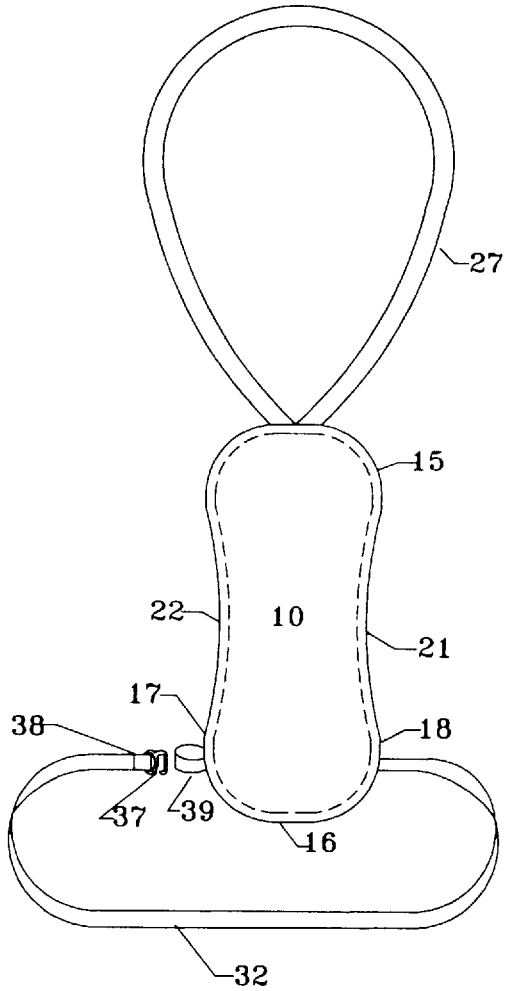
FIG. 3: shows the support item alone with the pad the neck and torso strap and fastener device.

Referring to the drawings in detail, the support item 1 includes an elongated pad 10 with top and bottom rounded ends 15 and 16 respectively and middle right and left concave sides 21 and 22, respectively. The bottom rounded end includes left and right sides, 17 and 18, respectively. The device includes a stretchable neck strap 27 attached to the top rounded end 15. The device further includes a stretchable torso strap 32 attached to the bottom right rounded end 18 with a fastener 37 secured to an unattached torso strap end 38 and a securing loop 39 is attached to the bottom left rounded end 18. The pad body 10 is constructed of a smooth fabric of lingerie quality, cut in the desired size and shape; again, the shape being as illustrated in the drawing with rounded upper and lower end and slightly narrowing or contouring center and sides to have a concave shape to fit between the breast. The body portion 10 is constructed of satin material and stuffed with polyester fiberfill. The pad is approximately 6½ inches long and 2½ inches wide. A fastening device is then affixed to the free ends of the torso strap. When the pad is worn, the pad overlies the cleavage area, the neck strap surrounds the neck, and the torso strap encircles the wearer's torso and the pad rest between the breast and protects the cleavage skin area from folding while sleeping on one side.

I claim:

1. A cleavage wrinkle pad comprising:

an elongated pad with a top and a bottom rounded end and middle right and left concave sides; the said bottom rounded end includes left and right sides;

a stretchable neck strap is attached to the top rounded end;

a stretchable torso strap is attached to the bottom right rounded end having a fastener secured to an unattached torso strap end and a mating securing loop 39 is attached to the bottom left rounded end;

the said pad is constructed of soft material and stuffed with a polyester fiberfill; the said pad is approximately 6½ inches long and 2½ inches wide; and wherein when the pad is worn, the pad overlies the cleavage area of a woman wearer, the neck strap surrounds the neck, the torso strap encircles the torso and the pad rest between the breast and protects the cleavage skin from folding while a wearer is sleeping one side.

* * * * *